US006957026B2

(12) United States Patent
Dergham et al.

(10) Patent No.: US 6,957,026 B2
(45) Date of Patent: Oct. 18, 2005

(54) DUAL AIRFLOW ENVIRONMENTAL MODULE TO PROVIDE BALANCED AND THERMODYNAMICALLY ADJUSTED AIRFLOWS FOR A DEVICE

(75) Inventors: Ali R. Dergham, Rochester, NY (US); Armando J. Rivera, Webster, NY (US); Francisco Zirilli, Penfield, NY (US); Mark A. Adiletta, Fairport, NY (US); Jonathan B. Hunter, Macedon, NY (US); Andrew C. LaRocca, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/779,711

(22) Filed: Feb. 18, 2004

(65) Prior Publication Data

US 2005/0180772 A1 Aug. 18, 2005

(51) Int. Cl.[7] ..... G03G 21/20
(52) U.S. Cl. ..... 399/92; 399/91; 399/94; 399/97
(58) Field of Search ..... 399/92, 93, 94, 399/97, 91

(56) References Cited

U.S. PATENT DOCUMENTS

| | | | | |
|---|---|---|---|---|
| 5,155,444 A | | 10/1992 | Green et al. | |
| 5,170,211 A | | 12/1992 | Haupt et al. | |
| 5,349,427 A | | 9/1994 | Benedict et al. | |
| 5,481,339 A | | 1/1996 | DeCock et al. | |
| 5,572,403 A | * | 11/1996 | Mills | 361/695 |
| 5,634,176 A | | 5/1997 | Ayash et al. | |
| 5,689,766 A | * | 11/1997 | Hollar et al. | 399/92 |
| 5,701,750 A | * | 12/1997 | Ray | 62/160 |
| 5,862,439 A | | 1/1999 | Pozzanghera | |
| 5,878,305 A | * | 3/1999 | Suzumura et al. | 399/97 |
| 5,930,558 A | * | 7/1999 | Raus et al. | 399/97 |
| 6,049,686 A | | 4/2000 | Folkins et al. | |
| 6,219,504 B1 | * | 4/2001 | Matsuzaki et al. | 399/92 |
| 6,266,498 B1 | * | 7/2001 | Oda et al. | 399/92 |
| 6,334,033 B1 | | 12/2001 | Ayash et al. | |
| 6,418,282 B1 | * | 7/2002 | Ayash et al. | 399/92 |
| 6,424,810 B1 | | 7/2002 | Chappell | |
| 6,621,554 B1 | | 9/2003 | Ayash et al. | |
| 6,701,104 B2 | * | 3/2004 | Chikano | 399/92 |
| 6,714,229 B2 | * | 3/2004 | Miyazaki et al. | 347/223 |

* cited by examiner

*Primary Examiner*—Ren Yan
*Assistant Examiner*—Dave A. Ghatt
(74) *Attorney, Agent, or Firm*—Oliff & Berridge, PLC

(57) ABSTRACT

An electrophotographic marking device includes a xerographic marking module and an environmental control module which controls temperature and relative humidity inside the marking module. The environmental module has a main plenum chamber and a divided or split plenum chamber to create and supply two air streams with different temperatures and/or different humidities and/or different airflow volumes and/or airflow rates to a marking engine. A primary air stream plenum chamber is closed loop controlled by input from one or more temperature and/or humidity sensors in the xerographic module. A secondary air stream plenum chamber is open loop controlled by means of one or more temperature and/or humidity sensors in one or mode developer housings. Heating of the secondary air stream is achieved by heat generated in the developer housing(s) and/or one or more heaters distinct from the developer unit elements. The system achieves balanced, thermodynamically adjusted, air flows.

8 Claims, 8 Drawing Sheets

DUAL AIRFLOW ENVIRONMENTAL MODULE TO PROVIDE BALANCED AND THERMODYNAMICALLY ADJUSTED AIRFLOWS FOR A DEVICE

BACKGROUND OF THE INVENTION

1. Field of Invention

The invention concerns maintaining suitable environmental conditions within a marking device.

2. Description of Related Art

U.S. Pat. No. 5,481,339 to DeCock et al. discloses an air conditioner device for an electrostatographic printer using environmental control. An air conditioning device is provided that has filters for removing dust and ozone from air leaving the environment of the image-producing station. DeCock et al. also provide a heat exchanger and a humidifier for adjusting the temperature and humidity of air leaving the environment of the image producing station, and an inlet manifold for introducing a stream of conditioned air into the environment of the image producing station. In one embodiment, the development station has an additional channel serving as an inlet for introducing a low speed stream of separately conditioned air to achieve an appropriate microclimate, in which the temperature and relative humidity are different from the air-conditioned environment in the printer cabinet to obtain optimum development results. This embodiment is operated with a common air inlet provided at the top of the marking cabinet.

U.S. Pat. No. 5,634,176 to Ayash et al. discloses an electrophotographic marking machine which has an air manifold system which supplies air flow to a plurality of machine components and which supports a component of the plurality of machine components.

U.S. Pat. No. 5,689,766 to Hollar et al. discloses an apparatus for maintaining a desired ambient condition about an electrophotographic marking module. An air flow source supplies air to an electrophotographic module chamber and sensors respond to the amount of air flow to control the air flowing from the air source.

U.S. Pat. No. 5,878,305 to Suzumura et al. discloses a liquid developing type of electrophotographic printer having a circulation means to take out and return gas generated in the printer casing, a gas cooling and solvent recovery means provided midway on the recirculation means to lower the gas concentration, means to detect the temperature and humidity of the gas in the casing, and a gas heating means downstream of the gas cooling and solvent recovery means to adjust the humidity of gas to be returned to the casing.

U.S. Pat. No. 6,621,554 to Ayash et al. discloses a method and apparatus to control the atmosphere in a xerographic control module of an image forming device so that the dew point is not reached. Parameters controlled within a xerographic chamber include air pressure, temperature and humidity. Both open and closed loop recirculation systems are disclosed.

U.S. Pat. No. 6,334,033 to Ayash et al. discloses an ambient atmospheric pressure compensation controller for a pressurized copying device.

SUMMARY OF THE INVENTION

Environmentally controlled marking engines have difficulty maintaining airflow balance between main print engine chamber air flow and developer housing and charger airflow streams.

The systems and methods of this invention provide an environmental module in which airflow balance is maintained for different components of a marking engine, such as, for example, overall main marking engine unit airflow and developer and/or charging sub-unit airflow streams in the sense that a predetermined ratio of the volume of air per unit time in each of two airstreams is maintained. Moreover, because the thermodynamic characteristics of the air flows, including temperature and moisture content of the air flows is adjusted to desired values using a common plenum, a thermodynamic adjustment of the airflows is also achieved.

The systems and methods of the invention provide an environmental unit which supplies separate air streams with different characteristics, such as, for example, temperature, pressure and moisture content, to a marking engine.

In various exemplary embodiments of the systems and methods of the invention provide an environmental unit that supplies one air stream to a marking engine unit and another air stream to developer housings and/or charging sub-units of the marking engine.

In various exemplary embodiments of the systems and methods of the invention provide an environmental unit/module which creates separate air streams using one or more split plenum arrangements.

In various exemplary embodiments of the systems and methods of the invention provide an environmental unit/module which creates a plurality of separate airstreams each of which may have different values of air pressure, flow velocity, moisture content, temperature and pressure.

In various exemplary embodiments of the systems and methods of the invention provide an environmental unit/module which creates a plurality of separate airstreams in which the values of air pressure, flow velocity, temperature and pressure may be varied.

In various exemplary embodiments of the systems and methods of the invention provide an environmental unit/module which creates and/or regulates one or more of the temperature, moisture content, flow rate and air pressure of a plurality of different airstreams in two separate plenum chambers.

In various exemplary embodiments of the systems and methods of the invention provide an environmental unit/module which creates a plurality of separate airstreams two or more of which may use separate blowers.

The systems and methods of the invention provide an environmental unit/module which creates a plurality of separate airstreams formed from a single plenum air stream using two or more separate plenum chambers.

The systems and methods of the invention provide an environmental unit/module which creates a plurality of separate airstreams formed from a single plenum air stream using two or more separate plenum chambers.

The systems and methods of the systems and methods of the invention provide a marking engine and/or reproduction system which includes an environmental unit/module having characteristics described above.

BRIEF DESCRIPTION OF THE DRAWINGS

Various exemplary embodiments of this invention will be described in detail, with reference to the following figures, wherein.

DETAILED DESCRIPTION OF EXEMPLARY EMBODIMENTS

Figure 1:
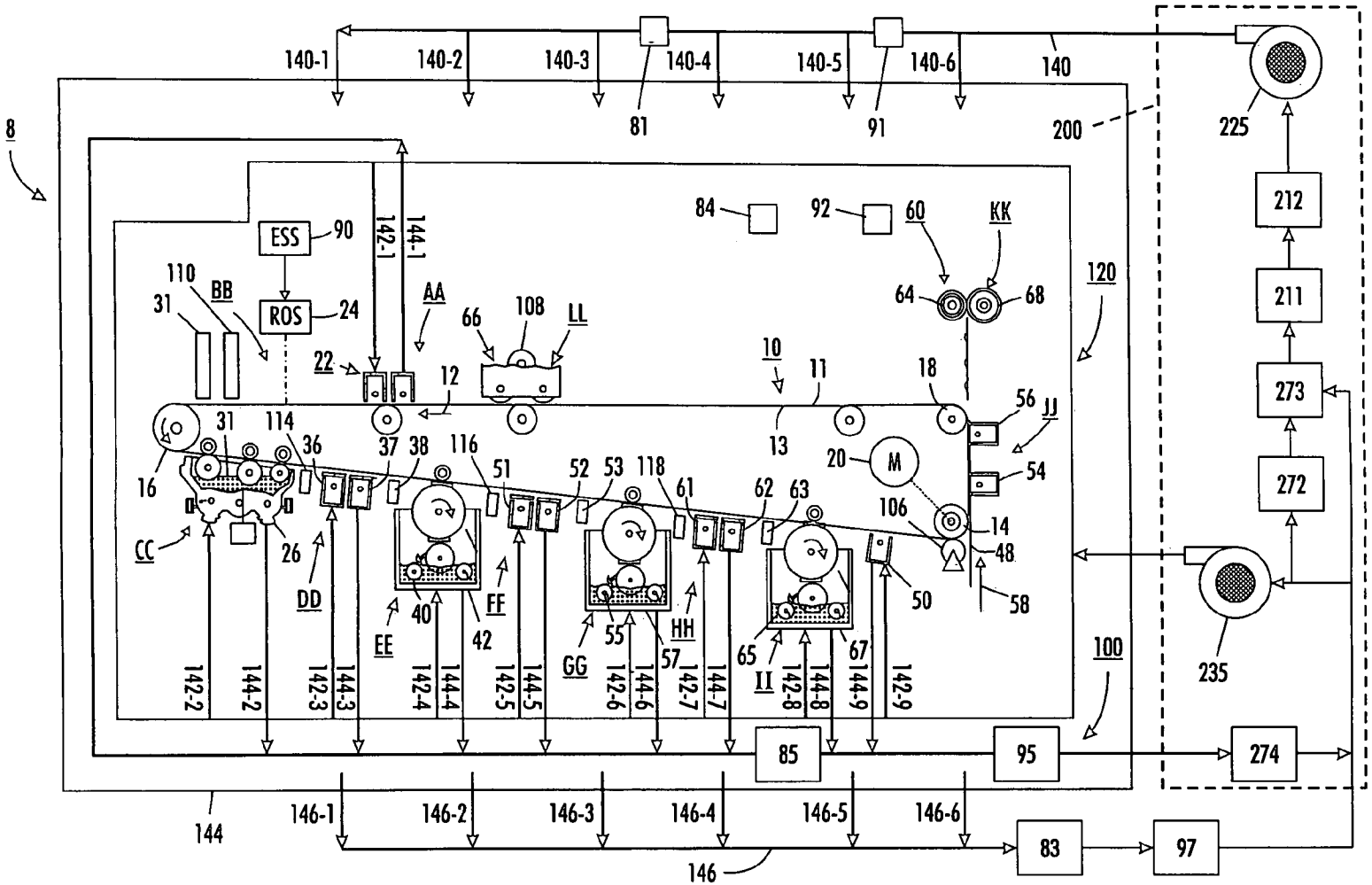
FIG. 1 is a schematic elevational view of an illustrative xerographic marking machine which has its environment controlled by an environmental unit.

The present invention will hereinafter be described in connection with a number of exemplary embodiments thereof. It will be understood that it is not intended to limit the invention to the exemplary embodiments. On the contrary, it is intended to cover all alternatives, modifications and equivalents that may be included within the spirit and scope of the invention.

For a general understanding of the features of the present invention, reference is made to the drawings. In the drawings, like reference numerals have been used throughout to designate identical elements. It will become evident from the following discussion that the balanced separate air stream systems and methods of the present invention are equally well suited for use in a wide variety of marking machines and are not necessarily limited in their application to the exemplary embodiments depicted herein.

Turning now to FIG. 1, there is illustrated a xerographic marking machine, such as an image-on-image machine 8. The marking machine 8 for example employs a photoreceptor 10 in the form of a belt having a photoconductive surface layer 11 on an electroconductive substrate 13. It is understood that the photoreceptor 10 equally can be in the form of a drum, in which case the belt-entraining rollers, described below, would not be needed. Photoreceptor belt 10 is supported for movement in the direction indicated by arrow 12, for advancing sequentially through various xerographic process stations. As shown, the belt is entrained about a drive roller 14 and two tension rollers 16 and 18. Drive roller 14 is operatively connected to a drive motor 20 for effecting movement of the belt through the xerographic stations.

With continued reference to FIG. 1, a portion of belt 10 first passes through charging station M where a corona generating device, indicated generally by the reference numeral 22, charges the photoconductive surface of belt 10 to a relatively high, and substantially uniform potential. For purposes of example, the photoreceptor is negatively charged, however it is understood that the present invention could be useful with a positively charged photoreceptor, by correspondingly varying the charge levels and polarities of the toners, recharge devices, and other relevant regions or devices involved in the image-on-image color image formation process, as will be hereinafter described.

Next, the charged portion of photoconductive surface is advanced through an imaging station BB. At imaging station BB, the uniformly charged belt 10 is exposed to a laser based output scanning device 24 which causes the charge retentive surface to be discharged in accordance with the output from the scanning device 24. Preferably the scanning device is a laser. Raster Output Scanner (ROS). Alternatively, the ROS could be replaced by other exposure devices, for example, a light lens system. Due to the exposure, an electrostatic latent image is recorded on the photoconductive surface of the photoreceptor belt 10.

At a first development station CC, a magnetic brush developer unit, indicated generally by the reference numeral 26, advances developer material 31 into contact with the electrostatic latent image on the photoreceptor belt 10. Developer unit 26 has a plurality of magnetic brush roller members. These magnetic brush rollers transport negatively charged dry toner material of a first color, such as black, to the latent image for development thereof. A power supply (not shown) electrically biases developer unit 26.

At a recharging station DD, a pair of corona recharge devices 36 and 37 adjust the voltage level of both the toned and untoned areas on the photoconductive surface to a substantially uniform level. A power supply is coupled to each of the electrodes of the corona recharge devices 36 and 37. Recharging devices 36 and 37 substantially eliminate any voltage difference between toned areas and bare untoned areas, as well as reduce the level of residual charge remaining on the previously toned areas, so that subsequent development of different color toner images is effected across a uniform development field.

A second exposure or imaging device 38 is then used to selectively discharge the photoreceptor on toned areas and/or bare areas. This records a second electrostatic latent image on the photoconductive surface. A negatively charged developer material 40, for example, yellow color toner, develops the second electrostatic latent image. The toner is contained in a developer unit 42 disposed at a second development station EE and is transported to the second latent image recorded on the photoconductive surface by a donor roll. A power supply (not shown) electrically biases the developer unit 42 to develop this latent image with the negatively charged toner particles 40.

At a second recharging station FF, a pair of corona recharge devices 51 and 52 adjust the voltage level of both the toned and untoned areas on the photoconductive surface to a substantially uniform level. A power supply is coupled to the electrodes of corona recharge devices 51 and 52. The recharging devices 51 and 52 substantially eliminate any voltage difference between toned areas and bare untoned areas, as well as reduce the level of residual charge remaining on the previously toned areas so that subsequent development of different color toner images is effected across a uniform development field.

A third latent image is recorded on the photoconductive surface by exposure/imaging device 53. This image is developed using a third developer material 55 contained in a developer unit 57 disposed at a third development station GG. An example of a suitable third developer material is magenta. Suitable electrical biasing of the developer unit 57 is provided by a power supply, not shown.

At a third recharging station HH, a pair of corona recharge devices 61 and 62 adjust the voltage level of both the toned and untoned areas on the photoconductive surface to a substantially uniform level. The recharging devices 61 and 62 substantially eliminate any voltage difference between toned areas and bare untoned areas as well as to reduce the level of residual charge remaining on the previously toned areas, so that subsequent development of different color toner images is effected across a uniform development field.

A fourth latent image is created using exposure/imaging device 63. The fourth latent image is formed on both bare areas and previously toned areas of the photoreceptor that are to be developed with the fourth color image. This image is developed, for example, using a cyan developer material 65 contained in developer unit 67 at a fourth development station II. Suitable electrical biasing of the developer unit 67 is provided by a power supply, not shown.

The dry developer material cases and developer units 42, 57, and 67 may be of the type known in the art which do not interact, or are only marginally interactive with previously developed images. For examples, a DC jumping development system, a powder cloud development system, and a sparse, non-contacting magnetic brush development system are each suitable for use in an image-on-image color development system.

In order to condition the toner for effective transfer to a substrate, a negative pre-transfer corotron member 50 negatively charges all toner particles to the required negative polarity to ensure proper subsequent transfer.

A sheet 48 of material to be marked is advanced, in the direction of arrow 58, to transfer station JJ by a sheet feeding apparatus, not shown. Preferably, the sheet feeding apparatus includes a feed roll contacting the uppermost sheet of a stack of copy sheets. The feed rolls rotate so as to advance the uppermost sheet from stack into a chute which directs the advancing sheet 48 into contact with photoconductive surface of belt 10 in a timed sequence so that the toner powder image developed thereon contacts the advancing sheet 48 at transfer station JJ.

Transfer station JJ includes a transfer corona device 54 which sprays positive ions onto the backside of sheet 48. This attracts the negatively charged toner powder images from the belt 10 to sheet 48. A detack corona device 56 is provided for facilitating stripping of the sheets from belt 10.

After transfer, the sheet 48 continues to move onto a conveyor (not shown) which advances the sheet to fusing station KK. Fusing station KK includes a fuser assembly, indicated generally by the reference numeral 60, which permanently affixes the transferred powder image to sheet 48. Preferably, fuser assembly 60 comprises a heated fuser roller 64 and a backup or pressure roller 68. The sheet 48 passes between fuser roller 64 and backup roller 68 with the toner powder image contacting fuser roller 64. In this manner, the toner powder images are permanently affixed to sheet 48. After fusing, a chute, not shown, guides the advancing sheet 48 to a catch tray, not shown, for subsequent removal from the marking machine by the operator.

After the sheet 48 is separated from photoconductive surface of belt 10, the residual toner carried on the photoconductive surface is removed therefrom. The toner is removed at cleaning station LL using a cleaning brush structure, including a flicker bar 108, contained in a housing 66.

The xerographic marking machine 8 includes the balanced airflow system of the present invention. Electrostatic Voltmeters (ESV) are utilized within xerographic machines to control the photoreceptor charging voltage, voltage increases of a charging device, and the charge level of charged area images on the photoreceptor. Similar electrostatic measurement devices are also used in xerographic machines for generating a modified electrical signal in proportion to an electrostatic potential present on a surface. Such a device may include a sensor for producing a signal representative of the electrostatic potential on the surface. The marking machine 8 may also contain an impulse air ejector cleaning system (not shown), such as, for example, the system disclosed in commonly assigned U.S. Pat. No. 5,862,439, the subject matter which is hereby incorporated by reference in its entirety. The balanced airflow system and methods of the invention and the various other machine functions described above are generally managed and regulated by a controller or electronic control subsystem (ESS) 90, preferably in the form of a programmable microprocessor. The microprocessor controller 90, connected for example by means (not shown) to environmental module 200, provides electrical command signals for operating all of the machine subsystems.

Figure 2:
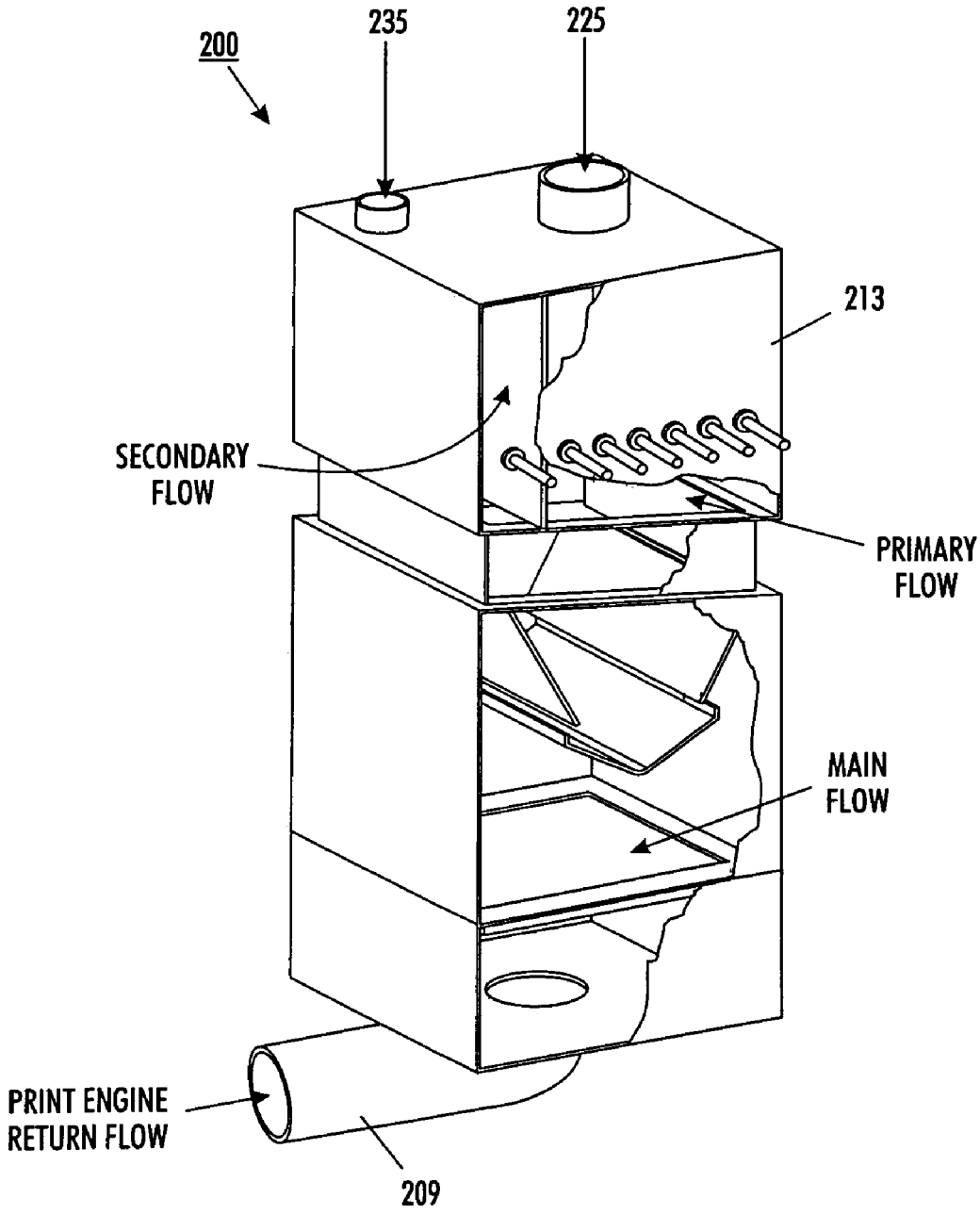
FIG. 2 is a three-dimensional or perspective view of an environmental unit according to the invention.
Figure 3:
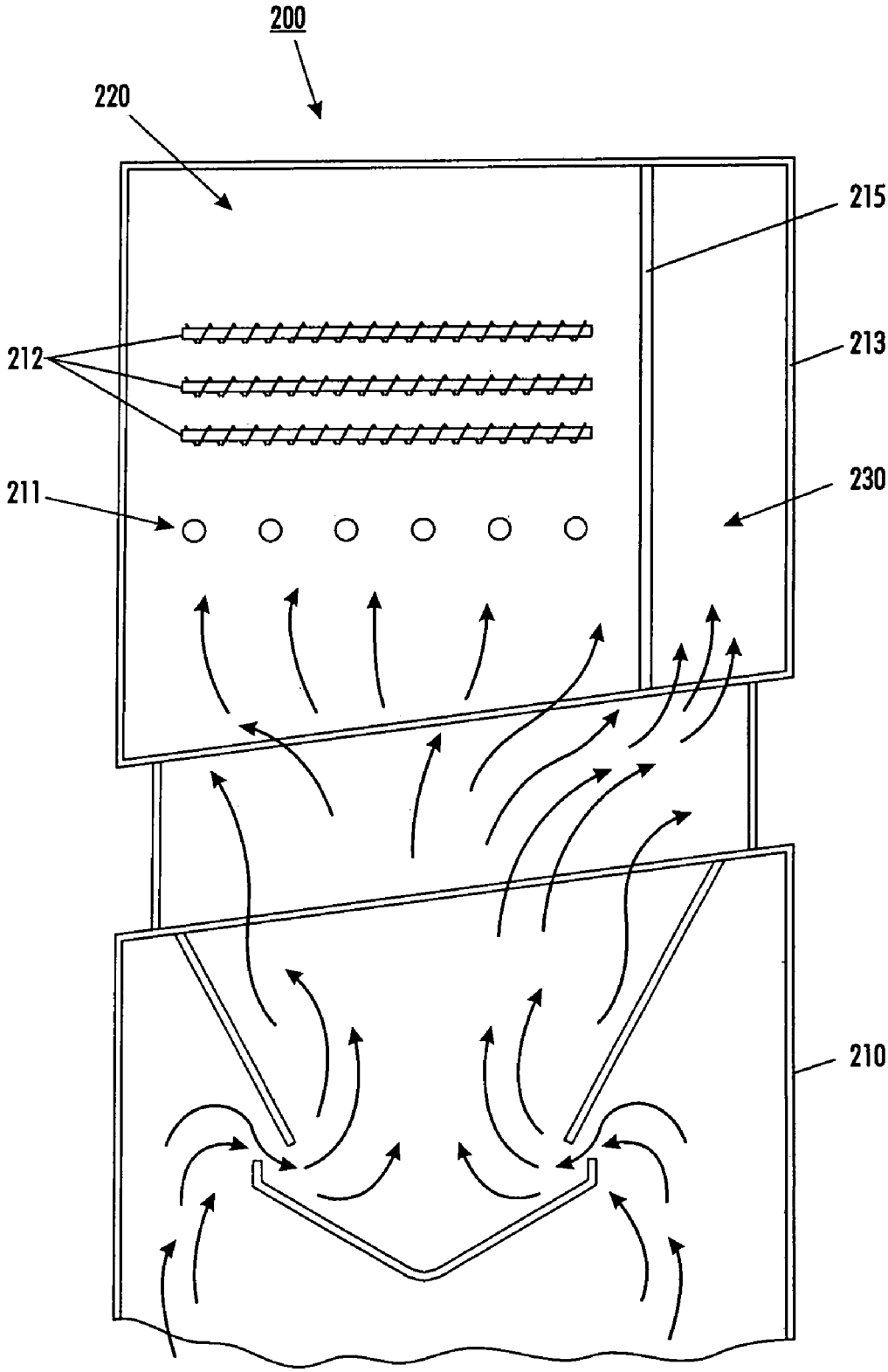
FIG. 3 is a cross-sectional view of the plenum of the environmental unit of FIG. 2.

A first exemplary embodiment of an environmental unit 200 using two cooling air flows is shown in FIGS. 2 and 3. In the environmental unit 200 shown in FIG. 2, air returning from the marking engine 8 of FIG. 1 flows through duct 209 into main flow plenum portion 210, where it is conditioned by including, for example, an ozone filter 272 and a HEPA filter 273 shown in FIG. 4. Reference is made to commonly assigned U.S. Pat. No. 5,170,211 which discloses use of a HEPA filter to remove particulates and contaminating gas from input air to a marking engine corona device and to remove harmful corona-generated effluents from the output, the disclosure of which is incorporated in its entirety herein by reference. The air is conditioned by cooling it by an evaporator 211 and by subsequently heating it by heater 212. Cooling the air in an evaporator allows moisture removal from the return air stream. Subsequent heating by heaters 212 is used to bring the temperature of the primary air stream to, or substantially to, the operating temperature of the xerographic cavity of the marking device 8. The secondary air stream is typically heated using a separate heater to control the secondary air stream to a set point which differs from the primary air stream set point. In other exemplary embodiments, the air may be heated before it is cooled.

The air is then passed directly, or indirectly through a transition plenum section 210, to plenum section 213, which has two compartments pr chambers 220 and 230 separated by a dividing wall 215. Plenum chamber 220 is the primary air flow plenum chamber through which most of the conditioned air is drawn by primary blower 225 to supply the conditioned air to marking engine module 8. In one exemplary embodiment, primary blower 225 supplies primary air to the marking engine module 8 at about 220 cubic feet per minute (CEM) and at about 77° F. plus or minus 3° F. A heater unit 212 is provided in the primary air flow plenum 220 to heat the air to the desired temperature.

Plenum chamber 230 is the secondary air flow chamber through which a relatively smaller amount of air is drawn by secondary blower 235. As shown in FIG. 1, this secondary air is directed to developer units CC, DD, EE, GG, II and/or charging units AA, DD, FF and HH by secondary blower 235. In one exemplary embodiment, secondary blower 235 supplies secondary air to the aforementioned developer and/or charging units at about 80 cubic feet per minute exiting the environmental unit 200 at a maximum temperature of about 55° F. In the exemplary embodiment of the marking engine module shown in FIG. 1, because there are four developer units, the conditioned flow reaching each unit is approximately 20 cubic feet per minute (CFM). The temperature of the secondary air flow may be adjusted by providing a separate heater in the secondary air flow path, and/or by using the heat generated by the developing units CC, EE, GG, and II.

In the exemplary embodiment shown in FIGS. 2 and 3, the primary plenum chamber 220 and the secondary plenum chamber 230 are coextensive and separated along their entire depth by a dividing wall or divider 215.

Figure 4:
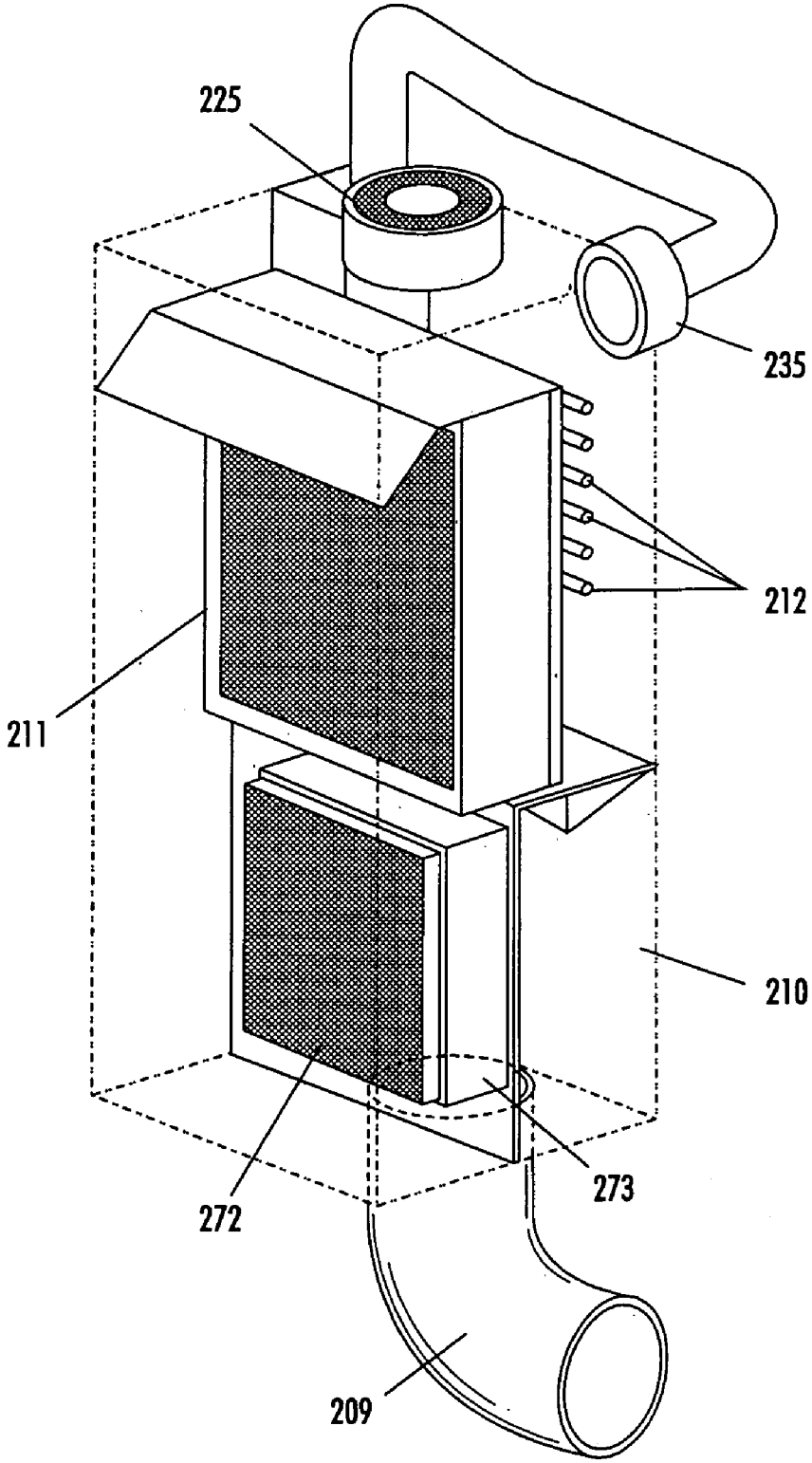
FIG. 4 is a perspective view of a second embodiment of an environmental unit according to the invention.

FIG. 4 shows a second exemplary embodiment of the environmental unit 200 according to this invention. In this second exemplary embodiment, an ozone filter 272 and a HEPA (High Efficiency Particulate Air) filter 273 are located in the main airflow plenum 210. An air conditioner evaporator coil unit 211 is located in the primary air flow plenum chamber 220 and a heater unit 212 is located in the primary air flow plenum 220. In this second embodiment, the secondary air flow plenum chamber 230 is separated from the primary air flow plenum 220 by a wall 215 that forms two sides of the secondary air flow plenum chamber 230. A condensate collection and drip pan 280, which also functions as an air flow diverter for air entering the main plenum chamber 210 from inlet such 209, is located in a position to separate the main plenum chamber 210 from the primary air flow chamber, 220.

Figure 5:
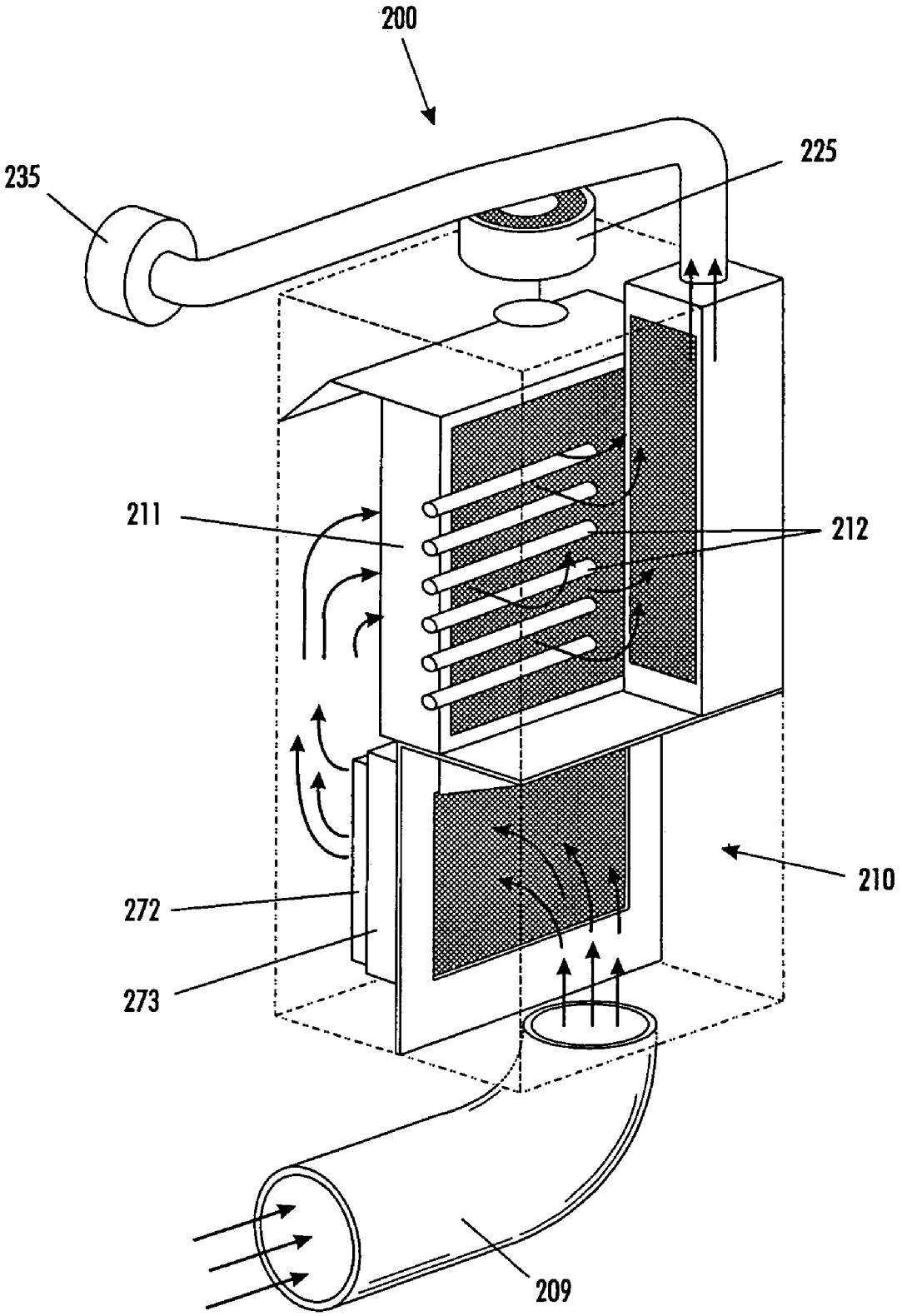
FIG. 5 is another perspective view of the environmental unit of FIG. 4 showing airflow direction in the unit.

FIG. 5 shows airflow directions in the second exemplary embodiment using arrows. Air from the marking engine enters the main flow plenum chamber 210 via duct 209, and is diverted by the condensate collector and drip pan 280 to pass through filters 272 and 273 and through air conditioner evaporator 211 and heater 212 to main blower 225 to duct 140 (shown in FIGS. 1 and 6) to the marking engine module 8. Also, as shown in FIG. 5, air is drawn by secondary air flow blower 235 from main plenum chamber 210 through secondary air flow plenum chamber 230 to the developer and charging units in marking machine 8.

Figure 6:
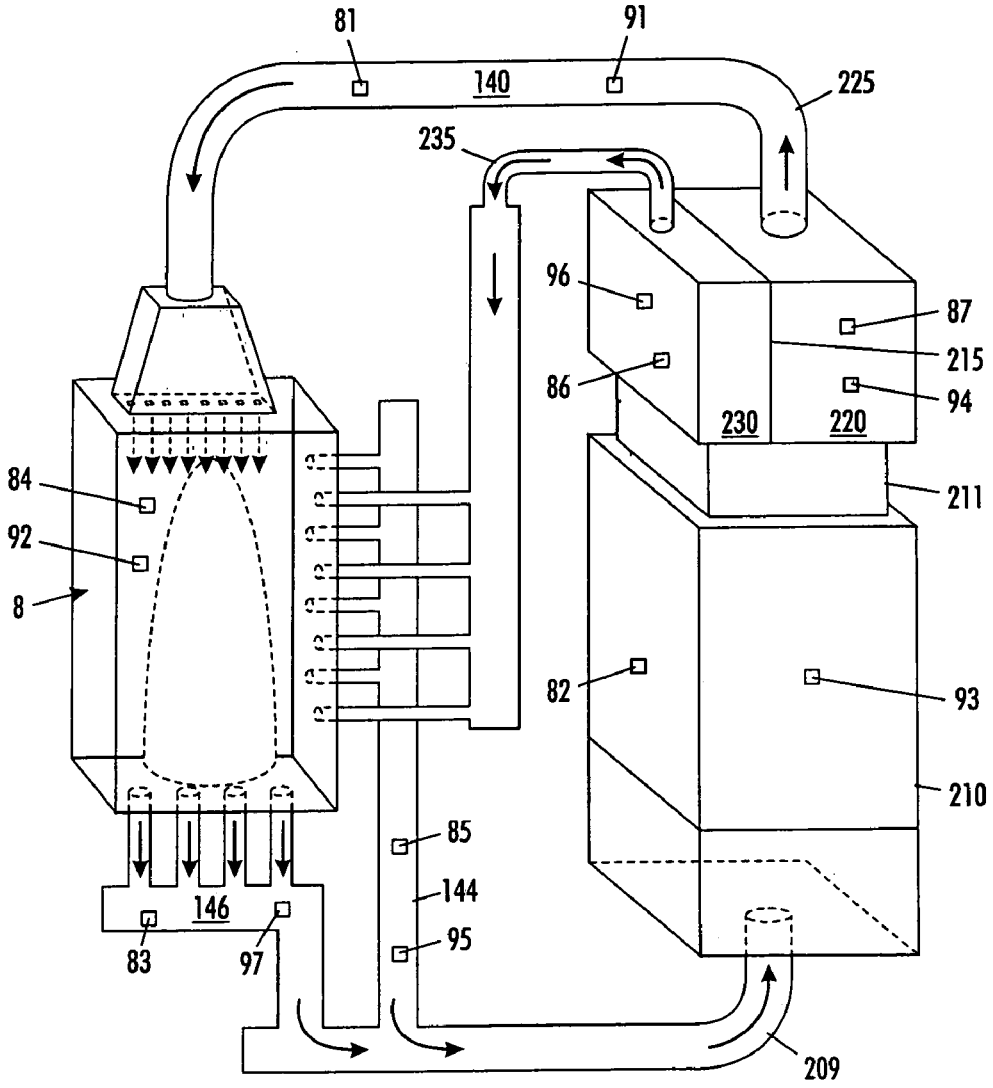
FIG. 6 is a block diagram schematically showing a marking machine and an associated environmental unit/module.

Temperature sensors may be placed in suitable locations in the overall system. FIGS. 1 and 6 show temperature sensor 81 located in the primary air flow inlet duct 140 for marking machine 8. A temperature sensor 85 is located in the primary air flow return duct 144. A temperature sensor 84 is located in the marking engine module 8. FIG. 6 shows a temperature sensor 83 in the main return manifold 146, a temperature sensor 82 in the main air flow plenum chamber 210, a temperature sensor 87 in the primary air flow plenum chamber 220 and a temperature sensor 86 in the secondary air flow plenum chamber 230.

Moisture content sensors, in the form of absolute or relative humidity sensors, may also be placed in suitable locations in the overall marking system. FIG. 1 shows a humidity sensor 91 located in the primary air flow inlet duct 140 for marking machine 8. A humidity sensor 92 is located in the marking engine module 8. A humidity sensor 95 is located in the primary air flow return duct 144. FIG. 6 shows a humidity sensor 93 in the main air flow plenum chamber 210, a humidity sensor 94 in the primary air flow plenum chamber 220, a humidity sensor 96 in the secondary air flow plenum chamber 230, and a humidity sensor 97 in the main return manifold 146.

One purpose of providing the temperature and moisture content sensors is to permit the system to condition the primary and secondary air flows to provide optimum environmental conditions for operation of the marking engine. In various exemplary embodiments of the systems and methods of the invention, this environmental control provides and maintains secondary air flow to the aforementioned developer and/or charging units at about 80 cubic feet per minute exiting the environmental unit 200 at a maximum temperature of about 55° F., and provides and maintains primary air flow to the marking engine module 8 at about 77° F. plus or minus 3° F.

Figure 7:
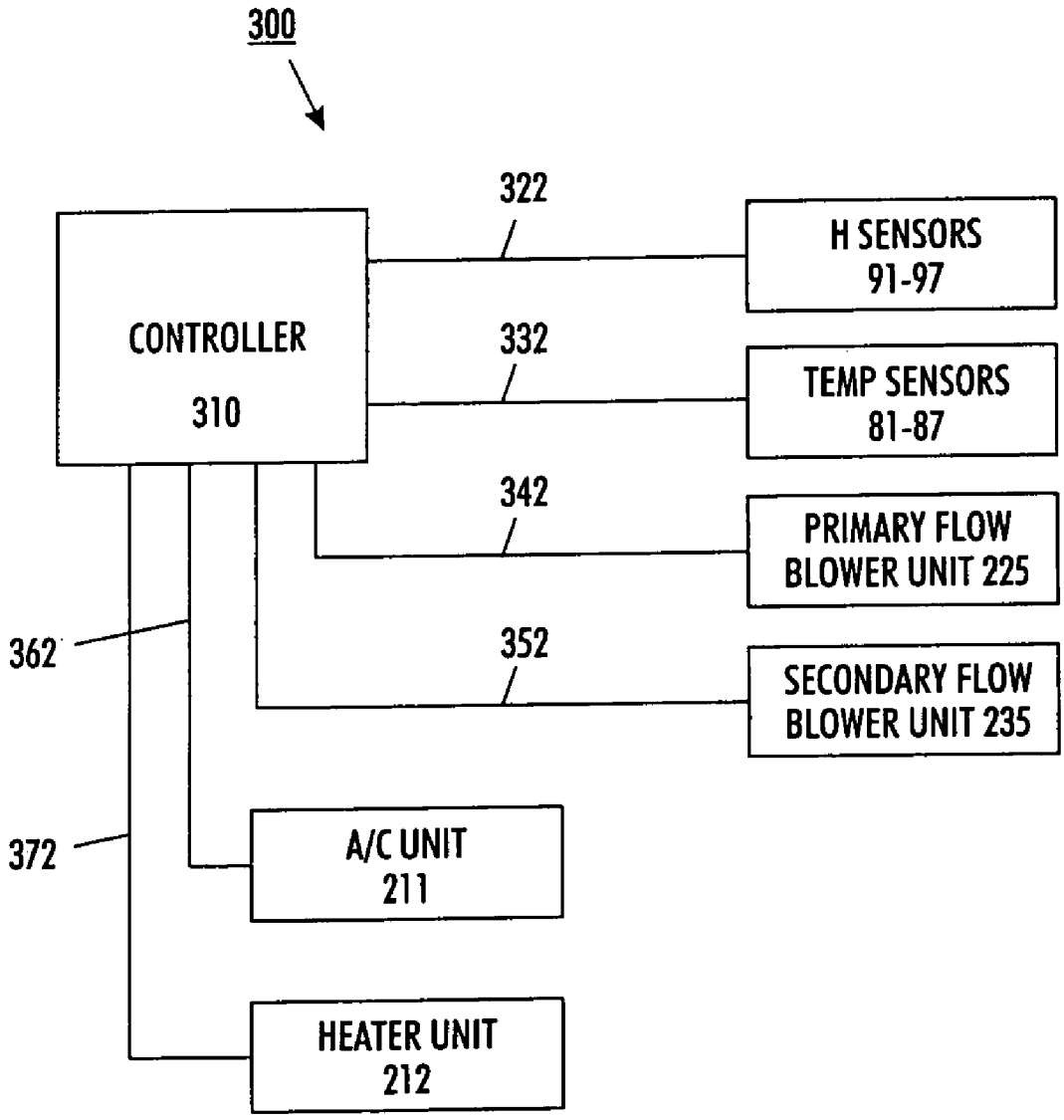
FIG. 7 is a block diagram of a control system according to this invention.

FIG. 7 shows one exemplary embodiment of a control system 300 usable to maintain the temperature and humidity characteristics of the primary and secondary air flowing through in the marking engine module 8, including the developing and charging units therein, to desired values to achieve maintain the developer units within a desired temperature and humidity range. As shown in FIG. 7, the control system includes a controller 310 connected via a link 322 to relative humidity sensors 91–97, a link 332 to temperature sensors 81–87, a link 362 to air conditioner (evaporator) unit 211, a link 372 to heater unit 212, a link 342 to primary air flow blower unit 225, and a link 352 to secondary air flow blower unit 235. The controller 310 receives signals from the relative humidity and temperature sensors and processes the signals to control the blower units 225 and 235, the air conditioner unit 211 and heater unit 212 to maintain air temperature and relative humidity in portion 8 within desired ranges, such as the ranges described above. In various exemplary embodiments, heating of the secondary air stream may be achieved using heat generated in the developer housing(s) and/or using one or more heaters distinct from the heater unit(s).

Moreover, with reference to U.S. Pat. No. 6,621,554, incorporated by reference, above, the system may be provided with air intake actuators and exhaust valve actuators to provide make-up air and/or otherwise alter the characteristics of the air flow in the system to achieve desired operational characteristics of the marking device.

Figure 8:
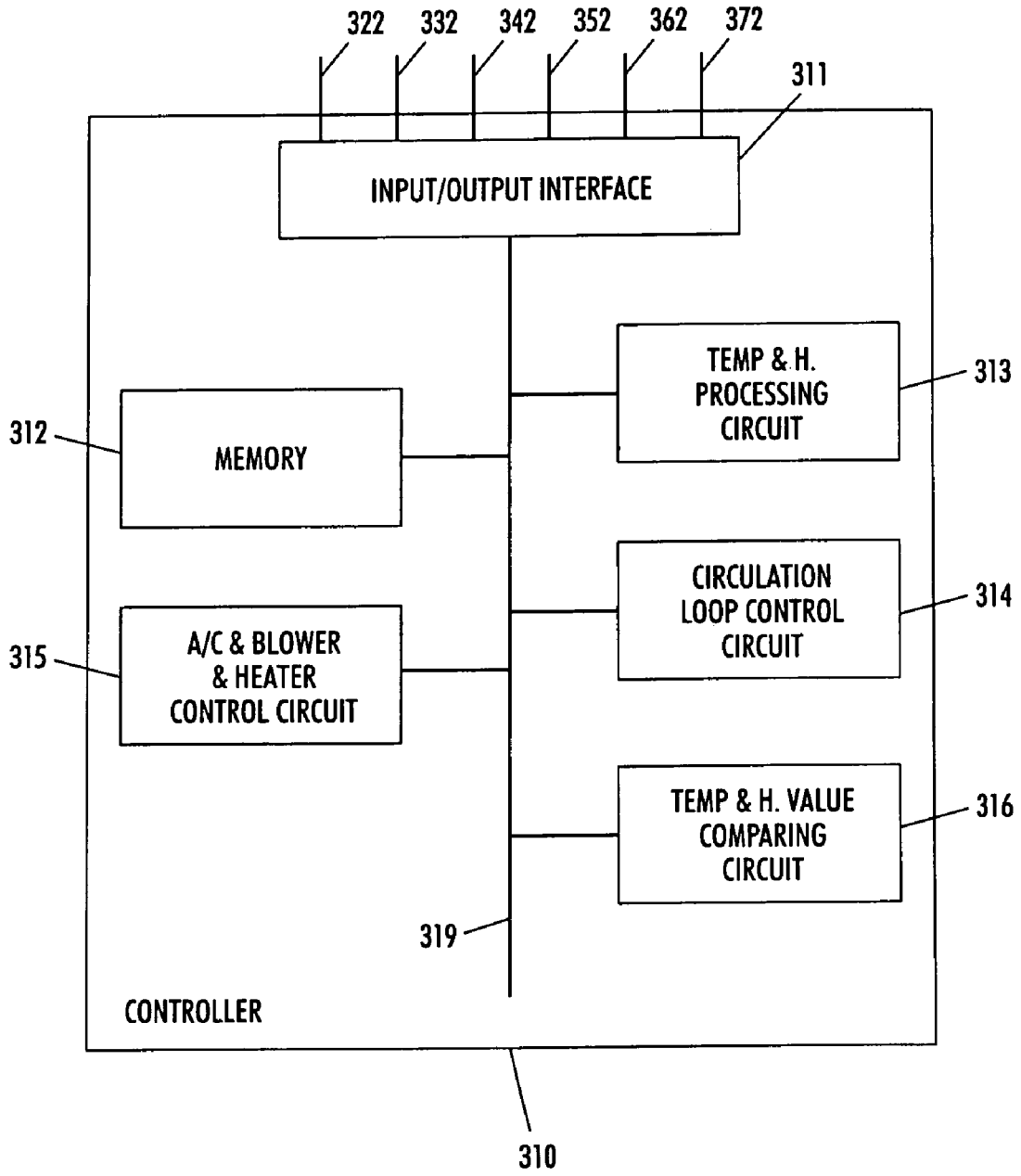
FIG. 8 is a block diagram of elements of a controller portion of the control system of this invention.

FIG. 8 shows in greater detail one exemplary embodiment of the controller 310. As shown in FIG. 8, the controller 310 includes an I/O interface 311, a memory 312, a temperature and humidity processing circuit 313, a circulation loop control circuit 314, an air conditioning and blower control circuit 315, and a temperature and humidity value comparing circuit 316, interconnected by a data control bus 319. The interface 311 connects to the links 322, 332, 342, 352, 362 and 372 and to the data/control bus 319 to transmit data and control signals to and from the control units 313–316 and/or memory 312 of the controller 310.

The controller 310 may be implemented on a programmed genera purpose computer. However, the controller 310, and any of the separate circuits therein, can also be implemented on a special purpose computer, a programmed microprocessor or microcontroller and peripheral integrated circuit elements, an ASIC or other integrated circuit, a digital signal processor, a hardwired electronic or logic circuit such as a discrete element circuit, a programmable logic device such as a PLD, PLA, FPGA or PAL, or the like. In general, any device capable of implementing a finite state machine that is in turn capable of implementing the control functions referred to above can be used to implement the invention. The links 322–372 can be implemented by any known or later developed device or system for connecting the controller 310 to the components 320–370. In general, the links 322–372 can be any known or later developed connection system or structure usable to connect the controller 310 to the components 320–370.

The memory 312 preferably implemented using static or dynamic RAM. However, the memory 312 can also be implemented using a floppy disk and disk drive, a writable optical disk and disk drive, a hard drive, flash memory or any other known or later developed alterable volatile or non-volatile memory device or system.

In operation, signals from the temperature sensors 81–86 and humidity sensors 91–96 are received by controller 310 through the interface 311. These signals are sampled by the temperature and humidity processing circuit 313 to determine the temperature and humidity of the air in marking engine module 8, and in the developer and charging units in module 8. These values are forwarded to a temperature and humidity value comparing circuit 316 where they are compared. The air conditioner blower and heater control circuit 315 is then used to adjust the air conditioner unit 211, heater unit 212, primary air flow blower 225, and secondary airflow blower unit 235, based on the comparisons of those values, to achieve desired temperature and humidity and flow rates of the air flow in the primary and secondary air flow paths.

In one exemplary embodiment, the system supplies about 220 CFM air to the marking engine module 8, which may also be referred to as a Xerographic cavity 8, to control it at 77° F. +/−3° F. and the system supplies about 80 CFM air to a developer cooling manifold 142 to supply about 20 CFM to each of the four developing units, and supply secondary air to the developer and charging units at a maximum temperature of about 55° F. to provide sufficient cooling to the developer housings to maintain the units, including a developer trim bar below about 90° F. Air is also supplied to each of the charging units. It should be understood that these temperatures may be varied depending on the characteristics of the marking engine components. Reference is made to U.S. patent U.S. Pat. No. 5,155,444 for details of a developer trim bar, the subject matter of which is hereby incorporated by reference in its entirety.

While this invention has been described in conjunction with the exemplary embodiments set forth above, it is evident that many alternatives, modifications and variations will be apparent to those skilled in the art. Accordingly, the exemplary embodiments of the invention, as set forth above, are intended to be illustrative, not limiting. Various changes may be, made without departing from the spirit and scope of the invention.

What is claimed is:

1. A dual air flow environmental module for a marking engine, comprising:

a plenum having a main air flow chamber, a primary air flow chamber fluidly connected to the main air flow chamber and a secondary air flow chamber fluidly connected to the main air flow chamber, the primary and secondary air flow chambers being located downstream of the main air flow chamber;

a wall dividing the primary air flow chamber from the secondary air flow chamber;

an air conditioning mechanism that adjusts the thermodynamic characteristics of the air flowing in the plenum;

a primary air flow blower that moves conditioned air from the primary air flow plenum chamber to the marking engine;

a secondary air flow blower that moves conditioned air from the secondary air flow plenum chamber to the marking engine;

a controller that operates the primary and secondary air flow blowers to provide balanced primary and secondary air flows to the marking engine.

2. The module of claim 1, wherein the controller operates the air conditioning mechanism to thermodynamically adjust the primary and secondary air flows.

3. The module of claim 1, further comprising a moisture source.

4. The module of claim 3, wherein the controller operates the moisture source to thermodynamically adjust the primary and secondary air flows.

5. The module of claim 1, further comprising at least one heater.

6. The module of claim 5, wherein the controller operates the heater to thermodynamically adjust the primary and secondary air flows.

7. A method of achieving balanced air flows in a dual air flow environmental module for a marking engine, comprising:

providing a main air flow plenum chamber, a primary air flow plenum chamber fluidly connected to the main air flow plenum chamber and a secondary air flow plenum chamber fluidly connected to the main air flow chamber, and locating the primary and secondary air flow plenum chambers above the main air flow chamber;

providing a wall dividing the primary air flow plenum chamber from the secondary air flow plenum chamber;

drawing air through the main and primary air flow plenum chambers;

drawing air through the main and secondary air flow plenum chambers; and providing balanced primary and secondary air flows in the marking engine.

8. The method of claim 7, further comprising thermodynamically adjusting the air flows.

* * * * *